US008522729B2

(12) United States Patent
Beckle et al.

(10) Patent No.: US 8,522,729 B2
(45) Date of Patent: Sep. 3, 2013

(54) CONTOURED FLAT STUD AND STUD ARRANGEMENT FOR CYCLONE SLAG TAPS

(75) Inventors: Bruce E. Beckle, Barberton, OH (US); Timothy P. Kors, Hobart, IN (US); Barry J. DeBois, North Canton, OH (US); Roger W. Sunderland, Clinton, OH (US); Christopher T. Marshall, Massillon, OH (US); Eugene R. Opryszko, Canton, OH (US); Gerland J. Maringo, Canton, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 974 days.

(21) Appl. No.: 12/175,524

(22) Filed: Jul. 18, 2008

(65) Prior Publication Data

US 2010/0012005 A1 Jan. 21, 2010

(51) Int. Cl.
*F22B 37/10* (2006.01)

(52) U.S. Cl.
USPC ..... 122/511; 122/DIG. 13

(58) Field of Classification Search
USPC ..... 122/510, 511, 512, DIG. 13, DIG. 14, 122/DIG. 16; 52/506.02, 506.03, 506.04; 165/134.1
See application file for complete search history.

(56) References Cited

U.S. PATENT DOCUMENTS

| | | | | |
|---|---|---|---|---|
| 4,554,967 | A * | 11/1985 | Johnson et al. | 165/134.1 |
| 4,635,713 | A * | 1/1987 | Johnson et al. | 165/134.1 |
| 4,683,112 | A * | 7/1987 | Badoux et al. | 376/402 |
| 4,934,322 | A * | 6/1990 | Fournier et al. | 122/6 A |
| 5,423,294 | A * | 6/1995 | Cole et al. | 122/512 |
| 5,800,775 | A * | 9/1998 | Vihnicka et al. | 266/230 |
| 6,102,694 | A * | 8/2000 | Lenz | 432/234 |
| 6,491,000 | B1 * | 12/2002 | Walker et al. | 122/512 |
| 6,727,612 | B1 * | 4/2004 | Hull et al. | 310/68 D |

* cited by examiner

*Primary Examiner* — Gregory A Wilson
(74) *Attorney, Agent, or Firm* — Eric Marich; Michael J. Seymour

(57) ABSTRACT

A stud and stud arrangement protects the water-cooled tubes of a slag tap outlet from corrosion and erosion by flowing slag and flue gas. The stud is a generally annular or ring-like segment. The stud has a projection terminating in an edge adapted to contact a tube at stud contact area, and has a weld surface for receiving a weld. The weld contacts a tube at a weld contact area and thermally and physically connects the stud to a tube. The weld surface area is greater than the stud contact area, thereby improving heat transfer between the tube and stud. The studs are disposed in an arrangement that is staggered in a direction perpendicular to the flow slag and flue gas.

9 Claims, 7 Drawing Sheets

CONTOURED FLAT STUD AND STUD ARRANGEMENT FOR CYCLONE SLAG TAPS

FIELD AND BACKGROUND OF INVENTION

The subject invention pertains in general to cyclone furnaces for burning ash-containing fuels, and in particular to studs used to protect the water-cooled tubes forming the slag tap outlet.

Cyclone furnaces were developed by The Babcock & Wilcox Company (B&W) in the 1940's. These cyclone furnaces have the ability to burn high-ash low-fusion temperature coals, which are particularly troublesome in pulverized coal boilers. FIG. 1 shows a cyclone furnace assembly 100, which comprises a generally horizontal barrel, typically 6 to 10 feet in diameter, attached to the side of a boiler furnace. The cyclone barrel is made up of water-cooled tubes 24, arranged in tangent-tube construction. Crushed coal is introduced through crushed coal inlet 32. Crushed coal and some air (primary 41 and tertiary 43) enter the cyclone through one or more specially designed burners on the front of the cyclone, such as radial burner 30.

In the main cyclone barrel, a swirling motion is created by the tangential addition of secondary air in the upper cyclone barrel wall through secondary air velocity dampers 45. A unique combustion pattern and circulating gas flow structure result. The products of combustion eventually leave the cyclone furnace through a re-entrant throat 60, which includes water cooled tubes 22 adapted to form a slag tap opening or outlet 20. A molten slag layer develops and advantageously coats the inside surface of the cyclone barrel. The slag drains to the bottom of the cyclone and is discharged through slag tap 20.

Cyclone furnaces are an integral part of the boiler heat absorbing circuitry and allow for a smaller boiler since about 70-90% of the original fuel ash is captured in the slag tapped out of the furnace.

For additional details of the design and operation of cyclone furnaces, the reader is referred to U.S. Pat. Nos. 2,357,301, and 5,878,700, assigned to the assignee of the present invention, and to Chapter 15 of *Steam/Its Generation and Use,* 41st Edition, The Babcock & Wilcox Company, Barberton, Ohio, U.S.A., © 2005, the texts of which are hereby incorporated by reference as though fully set forth herein.

Erosion and corrosion within the Cyclone are two critical issues which require routine maintenance measures. As shown in FIG. 1, a protective wear liner, made up of replaceable wear blocks or liners 51, is used to prevent excessive erosion at coal inlet 32. The material used for these blocks is normally comprised of metal, ceramic or a combination of the two. Knuckle studs 52 are placed next to wear blocks 51.

The cyclone's wet slagging environment produces a potentially corrosive iron sulfide attack on the pressure part tubing. Referring now to FIG. 2, in areas coated by the molten slag 72, water-cooled tubes 22, 24 are typically protected by a refractory layer 74 held in place by cylindrical pin studs 53. The pin studs 53 are welded to the outside surface of the tubes 22 in a very dense pattern. For example, the "super dense" pin studding offered by The Babcock & Wilcox Company may include ¾ inch long studs with 360 or more studs per square foot.

In addition to retaining the refractory, the pin studs cool the refractory surface in contact with the corrosive slag and help retard the corrosive action. The pin studs hold the refractory in place, thereby improving the refractory life span, and the refractory in turn helps protect the pin studs. This insulation maintains the cyclone at a high enough temperature to permit adequate slag tapping from the bottom of the unit, and significantly reduces erosion and corrosion potential.

To further reduce maintenance, The Babcock & Wilcox Company developed a flat, staggered stud design 54, shown in FIG. 1, which includes a hand applied fillet weld. The flat staggered stud design 54 offered the following advantages: 1) more precise stud manufacturing and closer spacing, 2) minimum potential for channeling and accelerated wear between the studs, 3) excellent heat transfer which reduces metal temperature and erosion rates, and 4) thicker stud sizes to extend life.

To reduce erosion and corrosion in the slag tap region of a cyclone furnace, The Babcock & Wilcox Company developed a contoured flat stud, designed for the tubes that make up the cyclone slag tap. The contoured design was developed to better fit a flat stud into the slag tap region. This original contoured stud was made of B&W 800 material, and had a generally arcuate shape, being designed as an annular or ring-like segment. Referring now to FIG. 3A, FIG. 3A is a cross-sectional view of two original contoured studs 1 applied to a water-cooled tube 22. Each original contoured stud 1 had an inner circumferential edge 2 that was contoured to contact the associated tube 22. Original contoured stud 1 had an upper side 6 and a lower side 8 each of which were flat and parallel to one another. Outer circumferential edge 4 connected upper side 6 to lower side 8 at right angles and ran parallel to inner edge 2. Outer circumferential edge 4 was exposed to slag and flue gas flowing through the slag tap opening when in use.

Original contoured stud 1 had a projection 9 extending from upper side 6 and lower side 8 and terminating in inner circumferential edge 2. Projection 9 had a concave weld recess 10 (shown as concave up in FIG. 3A) connecting upper side 6 to inner edge 2. Weld recess 10 was adapted to receive a weld 12, and had a weld recess depth 11 (FIG. 4A). Projection 9 also had a concave recess 14 (shown as concave down in FIG. 3A) located opposite recess 10 and connecting lower side 8 to inner edge 2. Concave recess 14 had a recess depth 15. Recess 14 of stud 1 was symmetric with recess 10, with weld recess depth 11 and recess depth 15 being equal.

In use, stud 1 was attached to tube 22 by fillet weld 12. Weld 12 contacted water-cooled tube 22 at weld contact area 13. Stud 1 itself contacted tube 22 at a stud contact area along inner edge 2. As shown in FIG. 3A, weld contact area 13 and the stud contact area of inner edge 2 were approximately equal.

As shown in FIG. 5A, original contoured studs 1 were arranged along the water-cooled tubes using an original contoured stud arrangement 90 in which a plurality of original contoured studs 1 were disposed about water cooled tubes 22 in a vertically staggered arrangement, i.e. staggered as the studs 1 were attached vertically, not offset in the direction of slag and flue gas flow 55.

While initial trials of original contoured stud 1 and original stud arrangement 90 showed some improvement, further reductions of erosion and corrosion rates were still desirable.

SUMMARY OF THE INVENTION

High maintenance and a high rate of tube failures in the cyclone slag tap region require that improved protection in this critical region be developed. Although the original contoured stud design and arrangement moved closer to improving this condition, an improved stud and stud arrangement was still warranted. The present invention provides additional protection in this critical area, thereby reducing maintenance costs and preventing tube leaks that occur in the region when studs and refractory do not adequately protect the tubes.

The present invention extends the life of the studs in the slag tap region by redesigning the stud arrangement, redesigning the stud itself to improve heat transfer between the stud and tube, and improving the material of the stud. Longer stud life in turn provides the benefits of reduced maintenance costs and longer overall tube life in the highly erosive and corrosive region of the cyclone slag tap.

Accordingly, one aspect of the invention is drawn to a stud for protecting a water-cooled tube. The stud has an annular segment having first and second sides and an outer edge connecting the sides. A projection extends from the sides and terminates in an inner edge contoured to contact a tube. The inner edge has an associated inner edge depth. The projection has a surface adapted to receive a weld between the inner edge and one of the sides. The weld surface has an associated weld depth, and the weld depth of the weld surface is greater than the inner edge depth.

Another aspect of the invention is drawn to a stud for protecting a water-cooled tube. The stud is an annular segment having parallel, flat sides connected by a circumferential outer edge perpendicular to the sides. A projection extends from the sides and terminates in a circumferential inner edge opposite and parallel to the outer edge. The inner edge is contoured to contact the tube along a stud contact area. The projection has a weld recess adapted to receive a weld between the inner edge and one of the sides. A weld fills the weld recess, thereby physically and thermally connecting the stud to the tube along a weld contact area, which is greater than the stud contact area.

Yet another aspect of the invention is drawn to a slag outlet. The slag outlet has a plurality of water-cooled tubes adapted to form a slag tap opening to discharge flowing flue gas and slag. The slag outlet also has a plurality of studs. Each stud is contoured to contact an adjacent water-cooled tube at a stud contact area and has a weld surface adapted to receive a weld. A weld fills each weld surface and contacts an adjacent water-cooled tube at a weld contact area, thereby physically and thermally connecting the stud to the tube. The flowing flue gas and slag define a flow direction, and the studs are staggered in a direction perpendicular to this flow direction.

The various features of novelty, which characterize the invention, are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification.

DESCRIPTION OF THE PREFERRED EMBODIMENTS

To further reduce erosion and corrosion in the slag tap region of a cyclone furnace, the present invention comprises an improved contoured stud design and an improved stud arrangement.

Figure 1:
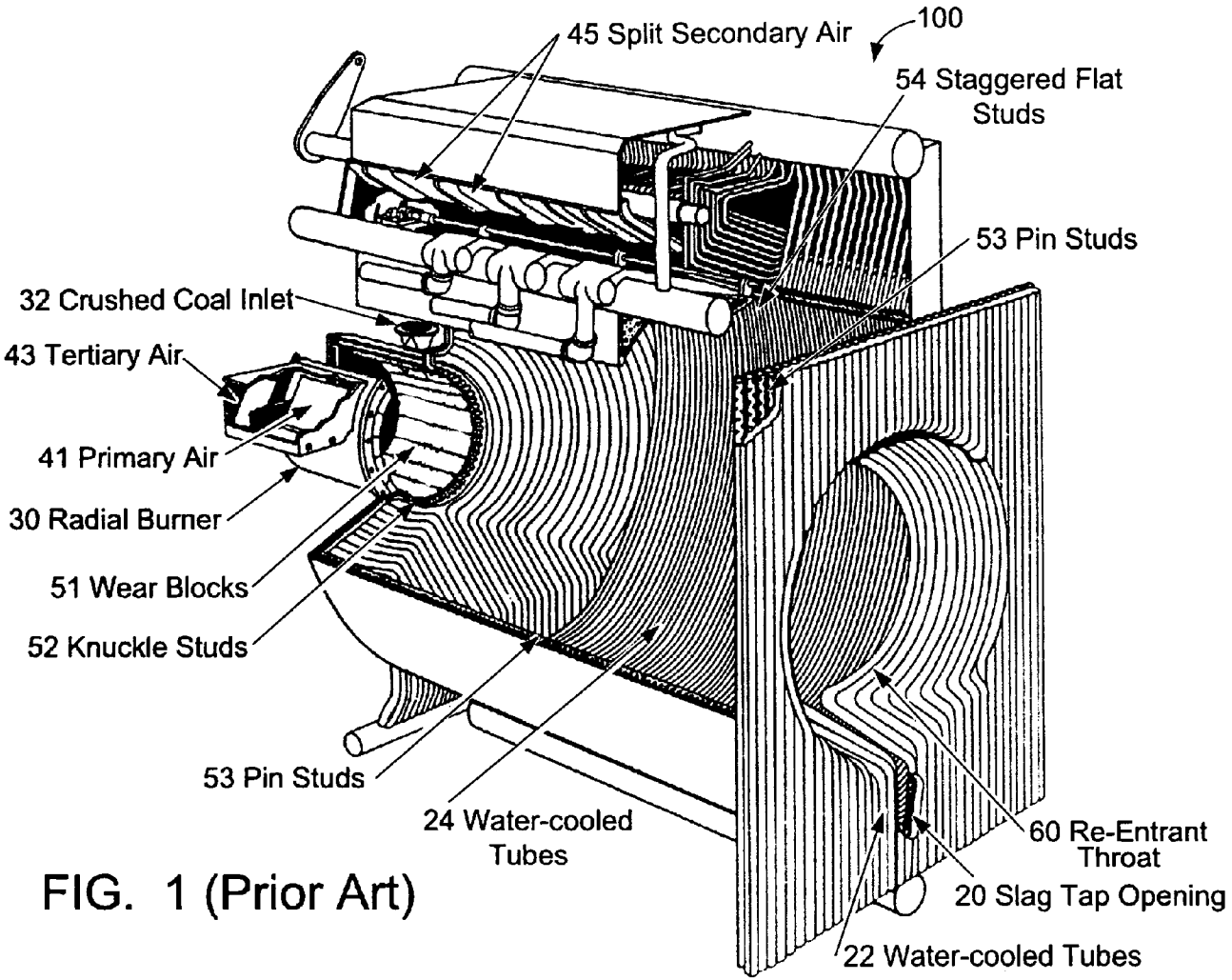
FIG. 1 (Prior Art)
FIG. 1 is a partial sectional perspective view of a cyclone furnace assembly where the present invention may be used.
Figure 2:
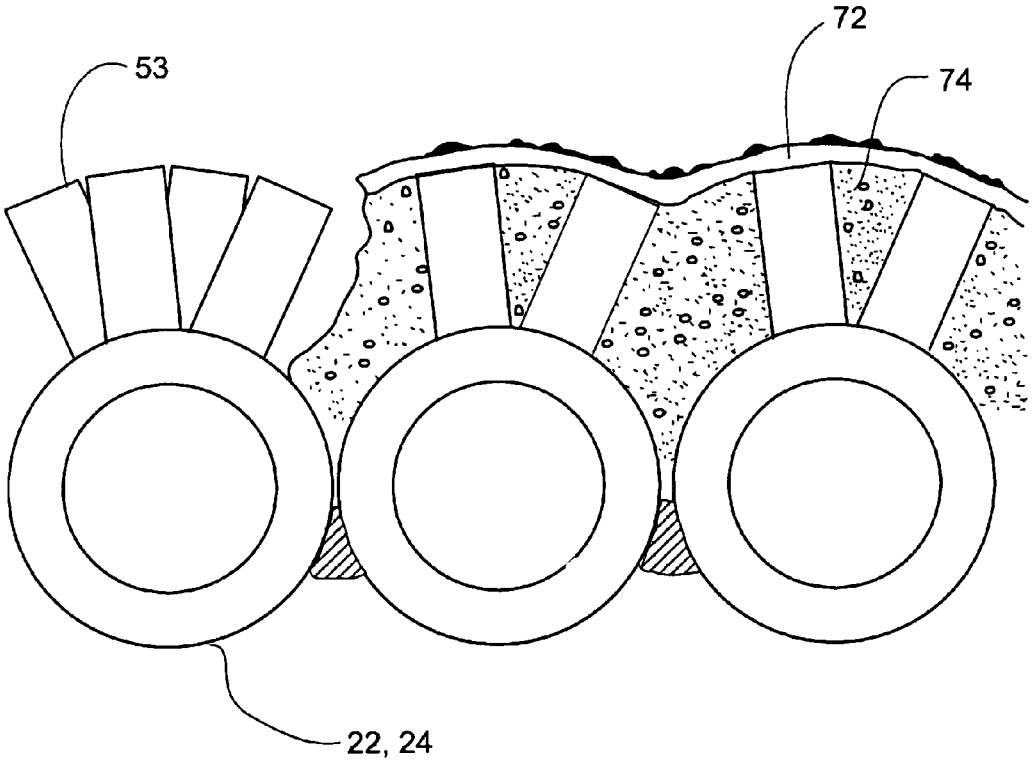
FIG. 2 (Prior Art)
FIG. 2 is a partial sectional view of a known cyclone furnace stud and stud arrangement.
Figure 3A:
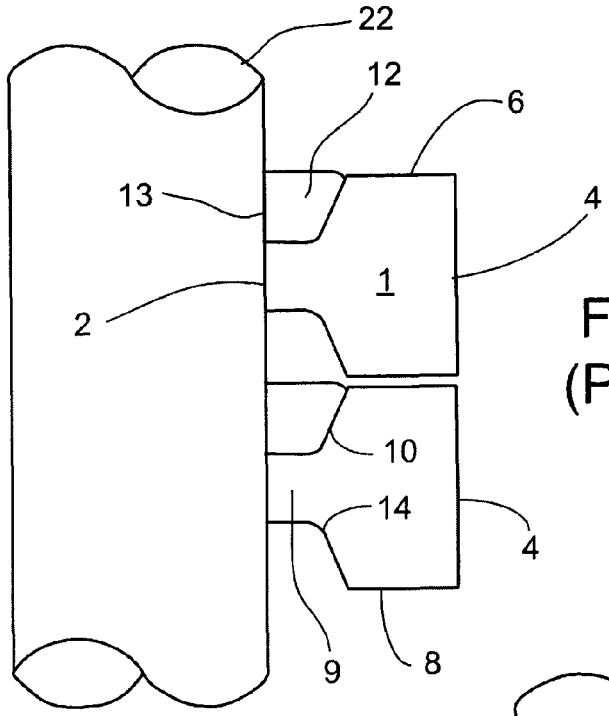
FIG. 3A (Prior Art)
FIGS. 3A and 4A are side sectional views of an original contoured stud.
Figure 3B:
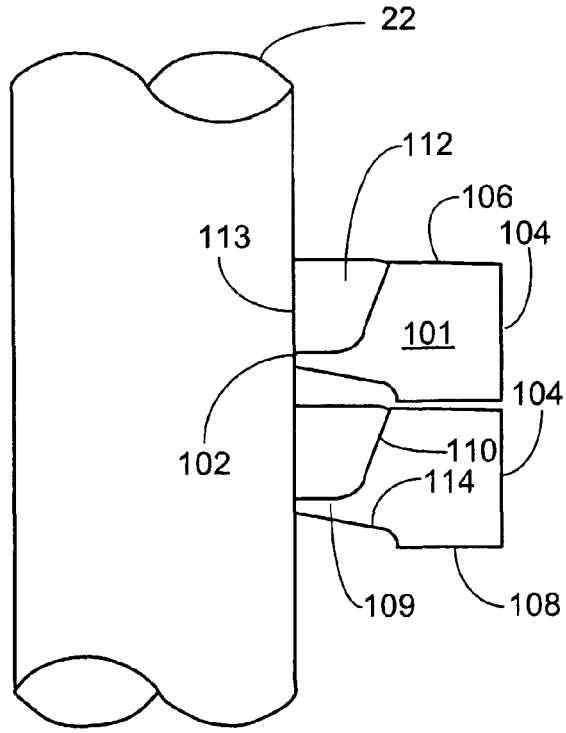
FIGS. 3B and 4B are side sectional views of an improved contoured stud.

An improved contoured stud 101 has been developed, as shown in FIG. 3B, which depicts two improved contoured studs 101 applied to a water-cooled tube 22. Similar to original contoured stud 1, improved contoured stud 101 has a generally arcuate shape, being designed as annular or ring-like segment. Improved contoured stud 101 preferably subtends an angle of about 30 to 45 degrees, i.e. so that a ring of about 12 to 8 studs would completely surround an associated tube 22.

Also similar to original contoured stud 1, improved contoured stud 101 has an inner circumferential edge 102. Inner edge 102 is contoured to contact the associated water-cooled tube 22, with inner edge 102 having a diameter slightly greater than the outer diameter of tube 22. Outer edge 104 of improved contoured stud 101 connects upper side 106 to lower side 108 at right angles thereto and runs parallel to inner edge 102. Upper side 106 and lower side 108 are preferably flat and parallel to one another. Outer circumferential edge 104 is exposed to flowing slag and flue gas when in use.

Figure 4A:
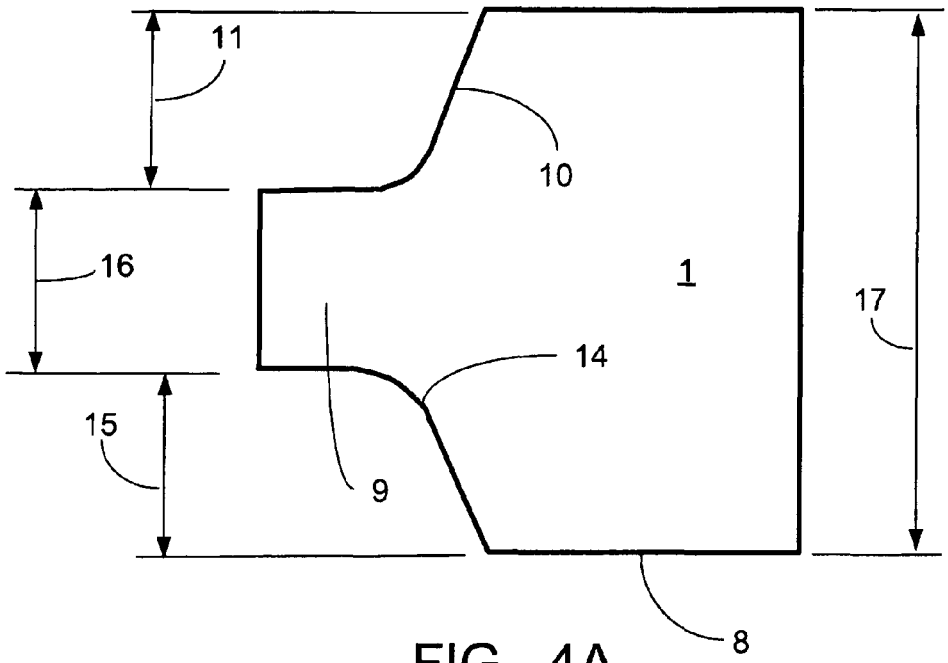
FIG. 4A (Prior Art)
Figure 4B:
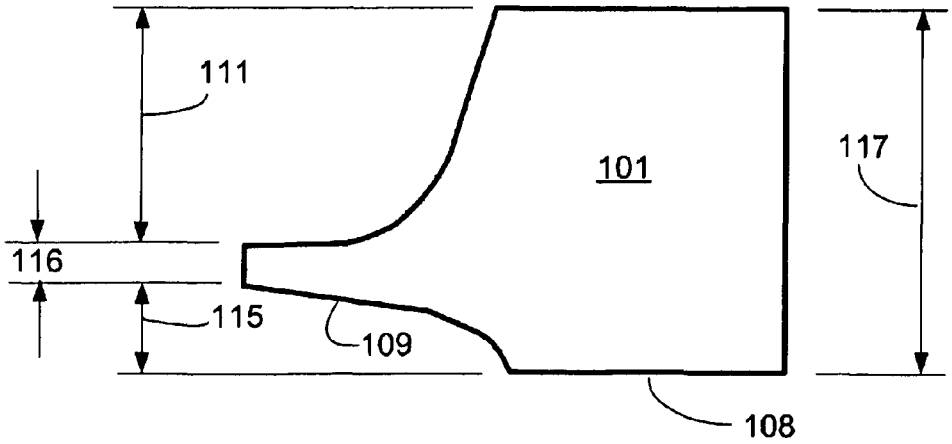

Referring now to both FIGS. 3B and 4B, also similar to original contoured stud 1, improved contoured stud 101 has a projection 109 extending from upper side 106 and lower side 108 and terminating in inner circumferential edge 102. Inner circumferential edge 102 has an inner edge depth 116. Projection 109 has a concave weld recess 110 (shown as concave up in FIG. 3B) connecting upper side 106 to inner edge 102. Recess 110 is adapted to receive a weld 112 and has a weld recess depth 111. Projection 109 also has a second concave recess 114 (shown as concave down in FIG. 3B) connecting lower side 108 to inner edge 102. Concave recess 114 has a recess depth 115.

In use, improved contoured stud 101 is attached to tube 22 by weld 112, which is preferably a fillet weld, as is known in the art. Weld 112 contacts water-cooled tube 22 at weld contact area 113, and improved stud 101 contacts the water-cooled tube 22 along inner edge 102.

The fillet weld design of original contoured stud 1, shown in FIG. 3A, left a large area of the original contoured stud 1 un-cooled by the water-cooled tube 22, since the weld area 13 was low relative to the stud contact area of inner edge 2. Contact resistance between the original contoured stud 1 and tube 22 thus reduced the ability of the water flowing in the tube 22 to cool the stud 1. As shown in FIGS. 3B and 4B, improved contoured stud 101 has been modified to maximize the weld contact area 113 between the stud 101 and the tube 22. In contrast with original contoured stud 1, the recesses of improved contoured stud 101, i.e. weld recess 110 and recess 114, are asymmetric, with weld recess depth 111 of recess 110 being greater than, and preferably substantially greater than, the recess depth 115 of recess 114. Weld contact area 113 is greater than the stud contact area along inner edge 102, thereby improving heat transfer between the water-cooled tube and improved stud 101. The larger weld contact area 113 thus helps maintain a lower operating stud temperature, which reduces stud overheating and oxidation conditions that would normally lead to shortened stud life. The depth 117 of outer edge 104 of improved stud 101 is also preferably reduced compared to depth 17 of outer edge 4 of original stud 1.

Improved contoured flat stud 101 preferably is made of ASTM 297A, to further improve wear life.

Figure 5A:
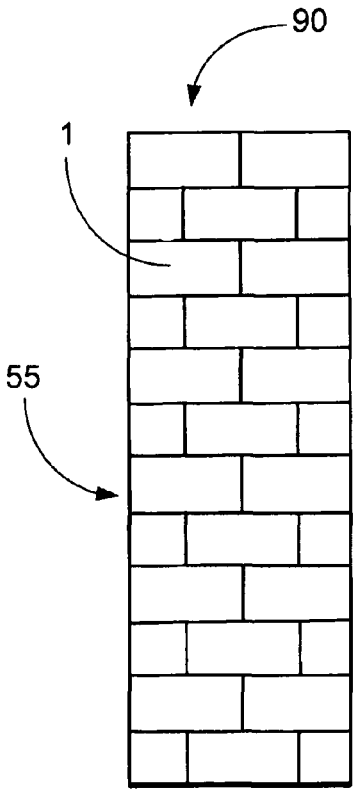
FIG. 5A (Prior Art)
FIG. 5A is a side view of an original contoured stud arrangement.
Figure 5B:
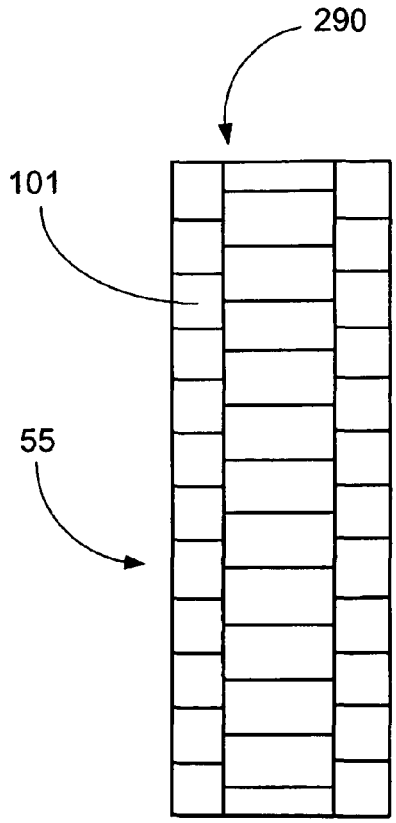
FIG. 5B is a side view of an improved contoured stud arrangement.
Figure 6A:
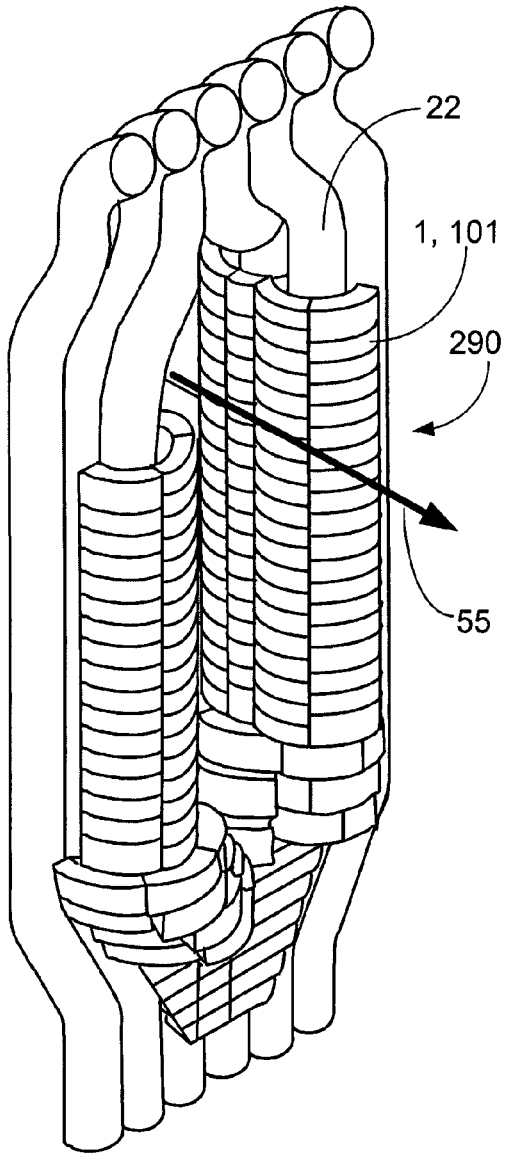
FIG. 6A is a perspective view, from a view point within a furnace looking into the cyclone assembly, of an improved contoured stud arrangement applied to a forced circulation cyclone.
Figure 6B:
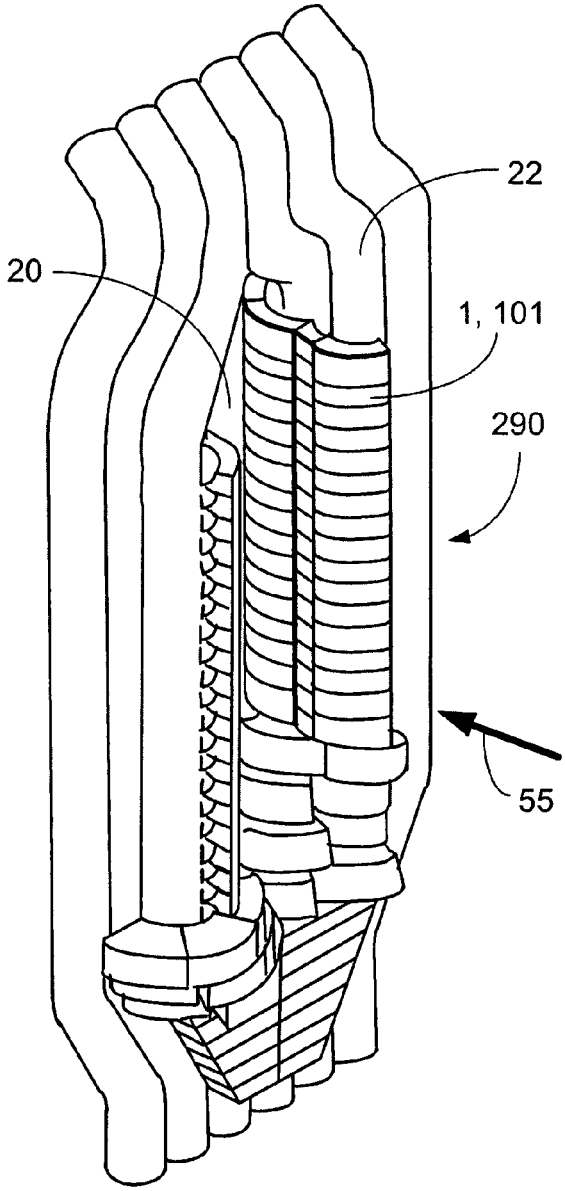
FIG. 6B is a perspective view, from a view point within a cyclone assembly looking out towards the furnace, of an improved contoured stud arrangement applied to a forced circulation cyclone.
Figure 7:
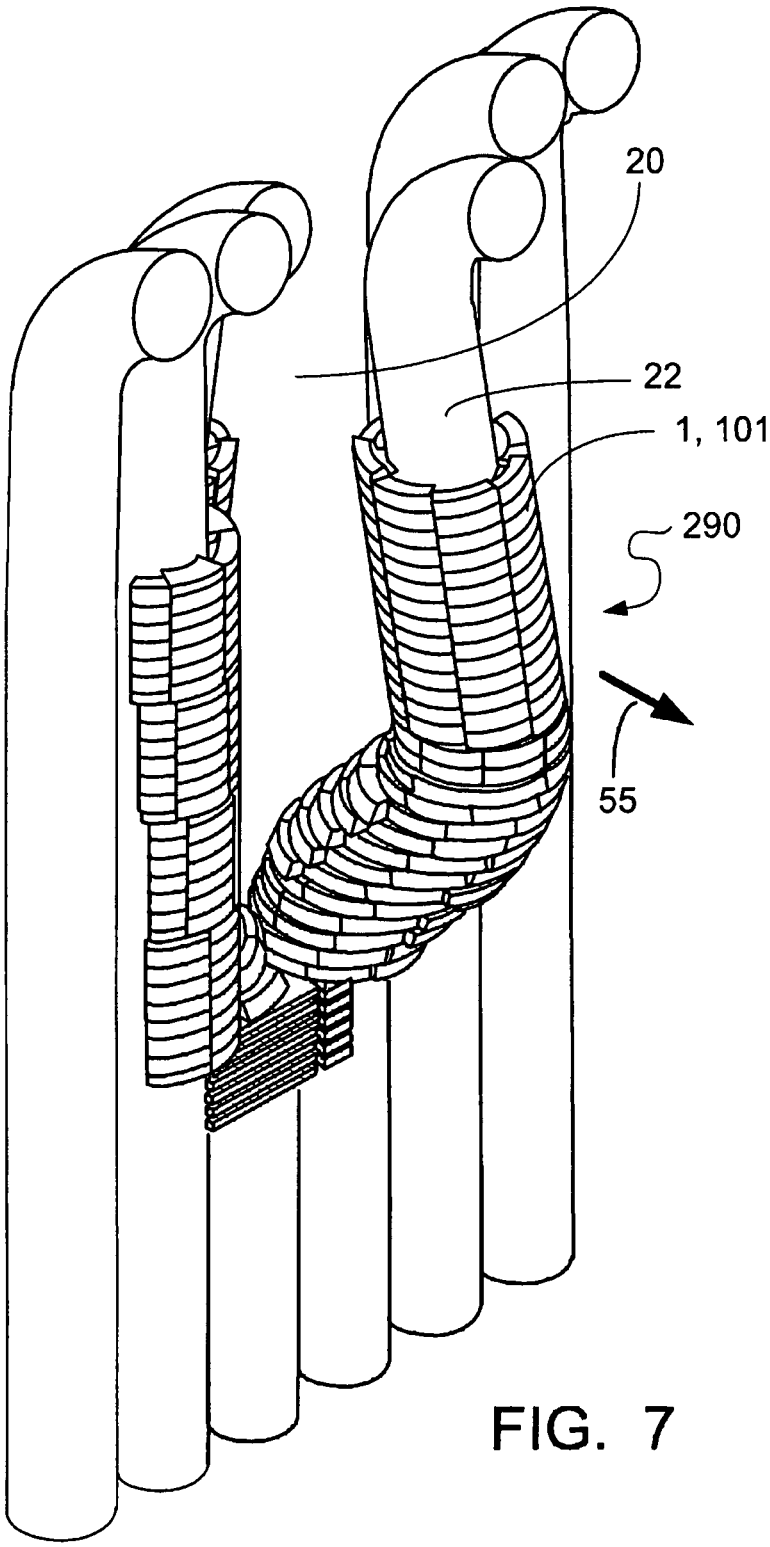
FIG. 7 is a perspective view, from a view point within a furnace looking into the cyclone assembly, of an improved contoured stud arrangement applied to a natural circulation cyclone.

FIGS. 5B, 6A, 6B and 7 show an improved stud arrangement 290 in which a plurality of studs 1, 101 are disposed about the water cooled tubes 22 of slag tap opening 20 in a more horizontally staggered arrangement compared to original stud arrangement 90 of FIG. 5A. In improved arrangement 290 the studs are stacked in vertical columns, with each column vertically offset from the adjacent vertical column. Staggering the studs in this way allows the stagger to face the flow of hot flue gas and molten running slag out of the tap, as indicated by flue gas and slag flow direction 55. In arrangement 290 studs 1, 101 are offset in a direction perpendicular to the flow direction 55, in contrast with stud arrangement 90, where the studs 1 are offset in a direction parallel to flow direction 55. FIGS. 6A and 6B show modified stud arrangement 290 applied to a forced circulation cyclone assembly. FIG. 7 shows modified stud arrangement 290 applied to a natural circulation cyclone assembly. Improved stud arrangement 290 may be used with original contoured studs 1, or preferably with improved contoured studs 101.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles. For example, while the subject invention is particularly useful for retrofit applications, it is equally applicable to new installations. In some embodiments of the invention, certain features of the invention may sometimes be used to advantage without a corresponding use of the other features. Accordingly, all such changes and embodiments properly fall within the scope of the following claims.

We claim:

1. A stud arrangement for protecting water-cooled tubes of a slag opening adapted to deliver a flow of flue gas and slag, comprising a plurality of studs, each of the studs comprising:
- an annular segment having first and second sides;
- an outer edge connecting the sides; and
- a projection extending from the sides and terminating in an inner edge contoured to contact a tube and defining an inner edge depth, the projection having a surface adapted to receive a fillet weld between the inner edge and one of the sides and defining a weld depth;
- wherein the weld depth is greater than the inner edge depth;
- wherein the plurality of studs are disposed about the water-cooled tubes of the slag tap opening in a substantially horizontally-staggered arrangement;
- wherein the studs are stacked in vertical columns, with each column vertically offset from the adjacent vertical column; and
- wherein the studs are offset in a direction perpendicular to a direction of the flow.

2. The stud of claim 1, wherein the weld surface is concave.

3. The stud of claim 1, wherein the projection has a second concave surface located opposite the weld surface.

4. The stud of claim 1, wherein the first and second sides are substantially flat and parallel to one another.

5. The stud of claim 4, wherein the outer edge is perpendicular to the first and second sides.

6. A stud arrangement for protecting water-cooled tubes of a slag opening adapted to deliver a flow of flue gas and slag, comprising a plurality of studs, each of the studs comprising:
- an annular segment having parallel, flat sides connected by a circumferential outer edge perpendicular to the sides;
- a projection extending from the sides and terminating in a circumferential inner edge opposite and parallel to the outer edge, the inner edge contoured to contact the tube along a stud contact area, the projection having a weld recess adapted to receive a fillet weld between the inner edge and one of the sides and a second recess opposite the weld recess; and
- a fillet weld filling the weld recess, thereby physically and thermally connecting the stud to the tube along a weld contact area;
- wherein the weld contact area is greater than the stud contact area; and
- wherein the weld recess and the second recess are concave, the weld recess being concave up and the second recess being concave down;
- wherein the plurality of studs are disposed about the water-cooled tubes of the slag tap opening in a substantially horizontally-staggered arrangement;
- wherein the studs are stacked in vertical columns, with each column vertically offset from the adjacent vertical column; and
- wherein the studs are offset in a direction perpendicular to a direction of the flow.

7. A slag outlet, comprising:
- a plurality of water-cooled tubes adapted to form a slag tap opening for discharging flowing flue gas and slag therethrough;
- a plurality of studs, each stud contoured to contact an adjacent water-cooled tube at a stud contact area and having a weld surface adapted to receive a weld; and
- a plurality of welds, each weld filling the weld surface of an associated stud and contacting an adjacent water-cooled tube at a weld contact area, thereby physically and thermally connecting the stud to the tube;
- wherein the flowing flue gas and slag define a flow direction, and the studs are staggered in a direction perpendicular to the flow direction;
- wherein the slag outlet discharges slag from a forced circulation cyclone;
- wherein the plurality of studs are disposed about the water-cooled tubes of the slag tap opening in a substantially horizontally-staggered arrangement; and
- wherein the studs are stacked in vertical columns, with each column vertically offset from the adjacent vertical column.

8. The slag outlet of claim 7, wherein the weld contact area of each stud is greater than the stud contact area of the stud.

9. A slag outlet, comprising:
- a plurality of water-cooled tubes adapted to form a slag tap opening for discharging flowing flue gas and slag therethrough;
- a plurality of studs, each stud contoured to contact an adjacent water-cooled tube at a stud contact area and having a weld surface adapted to receive a weld;
- a plurality of welds, each weld filling the weld surface of an associated stud and contacting an adjacent water-cooled tube at a weld contact area, thereby physically and thermally connecting the stud to the tube; and wherein the flowing flue gas and slag define a flow direction, and the studs are staggered in a direction perpendicular to the flow direction;

wherein the slag outlet discharges slag from a natural circulation cyclone;

wherein the plurality of studs are disposed about the water-cooled tubes of the slag tap opening in a substantially horizontally-staggered arrangement; and wherein the studs are stacked in vertical columns, with each column vertically offset from the adjacent vertical column.

* * * * *